US006095062A

United States Patent [19]

Mouton

[11] Patent Number: 6,095,062

[45] Date of Patent: Aug. 1, 2000

[54] BALANCE TABLE

[76] Inventor: Onezieme R. Mouton, 401 Peden, Houston, Tex. 77006

[21] Appl. No.: 09/267,802

[22] Filed: Mar. 12, 1999

[51] Int. Cl.[7] ..... A47B 13/02

[52] U.S. Cl. ..... 108/150

[58] Field of Search ..... 108/150, 49, 108, 108/94, 95

[56] References Cited

U.S. PATENT DOCUMENTS

| | | | |
|---|---|---|---|
| D. 298,595 | 11/1988 | Cionini . | |
| D. 332,539 | 1/1993 | Loznikov . | |
| D. 386,632 | 11/1997 | Robinson . | |
| 749,525 | 1/1904 | Buehl | 108/94 |
| 3,543,312 | 12/1970 | Pofferi | 108/49 |
| 3,658,285 | 4/1972 | Cohen . | |
| 3,698,328 | 10/1972 | Weir | 108/49 X |
| 3,903,812 | 9/1975 | Cowley | 108/150 X |
| 4,122,956 | 10/1978 | Hargrove | 108/94 X |
| 4,819,138 | 4/1989 | Polick . | |
| 5,038,434 | 8/1991 | Navarrette | 108/49 X |
| 5,771,613 | 6/1998 | Geils et al. | 108/150 X |
| 5,802,987 | 9/1998 | Bellak et al. | 108/108 |

*Primary Examiner*—Jose V. Chen
*Attorney, Agent, or Firm*—John R Casperson

[57] ABSTRACT

A cantilevered base is provided for a table top. The base has a lower support surface and an oppositely facing upper support surface positioned parallel thereto. The lower support surface is for supporting the base on a generally horizontal surface. The upper support surface is for supporting a table top. Each support surface has a center point. The upper support surface is spaced apart from the lower support surface in both a vertical direction and a horizontal direction, as measured between the center point of the upper support surface and the center point of the lower support surface when the lower support surface is supported on a generally horizontal surface. The base further has an upper arm portion and a lower arm portion, each having a longitudinal axis. The upper support surface is positioned on an upper end of the upper arm portion and the lower support surface is positioned on a lower end of the lower arm portion. The lower end of the upper arm portion and the upper end of the lower arm portion come together to form an elbow with the longitudinal axis of the upper arm portion forming an angle in the range of from about 110 to about 160 degrees with respect to the longitudinal axis of the lower arm portion. The longitudinal axis of the upper arm portion lies in a first plane which extends normal to the upper support surface and the longitudinal axis of the lower arm portion lies in a second plane which extends normal to the lower support surface. The first plane is normal to the second plane. The base is used by supporting a tabletop on the upper support surface of the base.

10 Claims, 3 Drawing Sheets

BALANCE TABLE

BACKGROUND OF THE INVENTION

In one aspect, this invention relates to a base for a table top. In another aspect, this invention relates to a cantilevered table or a balance table.

Many different designs for tables and table bases are known in the prior art.

The present invention provides a unique cantilever or balance design that can be used with tables of all sizes, including coffee tables, end tables, game tables, and dining tables.

SUMMARY OF THE INVENTION

One aspect of the invention provides a cantilever base for a table top. The base has a lower support surface and an oppositely facing upper support surface positioned parallel thereto. The lower support surface is for supporting the base on a generally horizontal surface. The upper support surface is for supporting a table top.

Each support surface defines a support area having a center point. The tipper support surface is spaced apart from the lower support surface in both a vertical direction and a horizontal direction, as measured between the center point of the upper support area and the center point of the lower support area when the lower support surface is supported on a generally horizontal surface.

The base further has an upper arm portion and a lower arm portion, each having a longitudinal axis. The upper support surface is positioned on an upper end of the upper arm portion and the lower support surface is positioned on a lower end of the lower arm portion. The lower end of the upper arm portion and the upper end of the lower arm portion come together to form an elbow with the longitudinal axis of the upper arm portion forming an angle in the range of from about 110 to about 160 degrees with respect to the longitudinal axis of the lower arm portion. The longitudinal axis of the upper arm portion lies in a first plane which extends normal to the upper support surface and the longitudinal axis of the lower arm portion lies in a second plane which extends normal to the lower support surface. The first plane is normal to the second plane.

The base is used by supporting a tabletop on the upper support surface of the base.

DETAILED DESCRIPTION OF THE INVENTION

Figure 1:
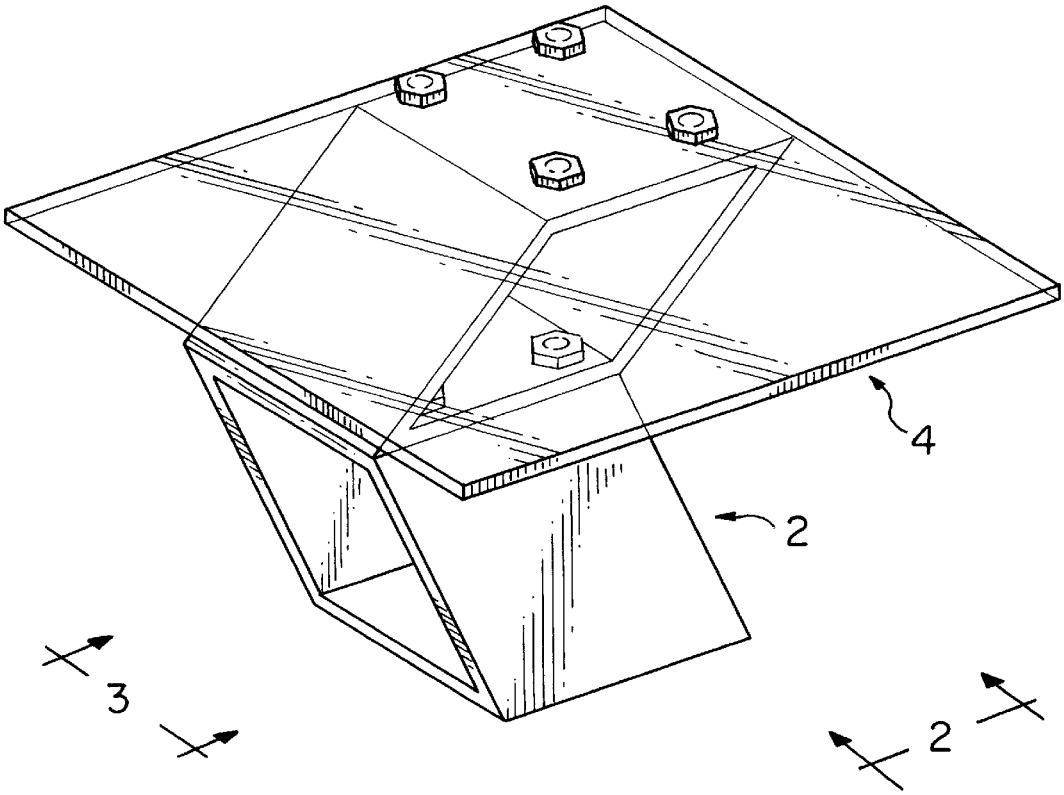
FIG. 1 is a pictorial representation of one embodiment of the present invention.

FIG. 1 illustrates a cantilever base 2 supporting a table top 4. A glass table top 4 is shown, for convenience in describing the present invention. However, any material having adequate structural integrity can be used. Exemplary suitable materials are wood, metal, stone, concrete, or combinations such as stone veneer over plywood.

Figure 4:
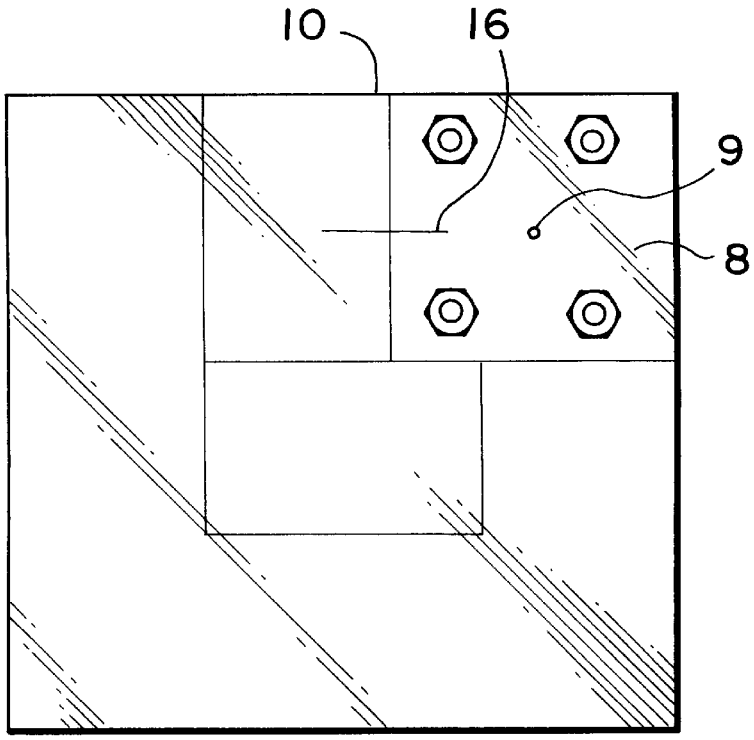
FIG. 4 is a top view of the invention of FIG. 1.
Figure 5:
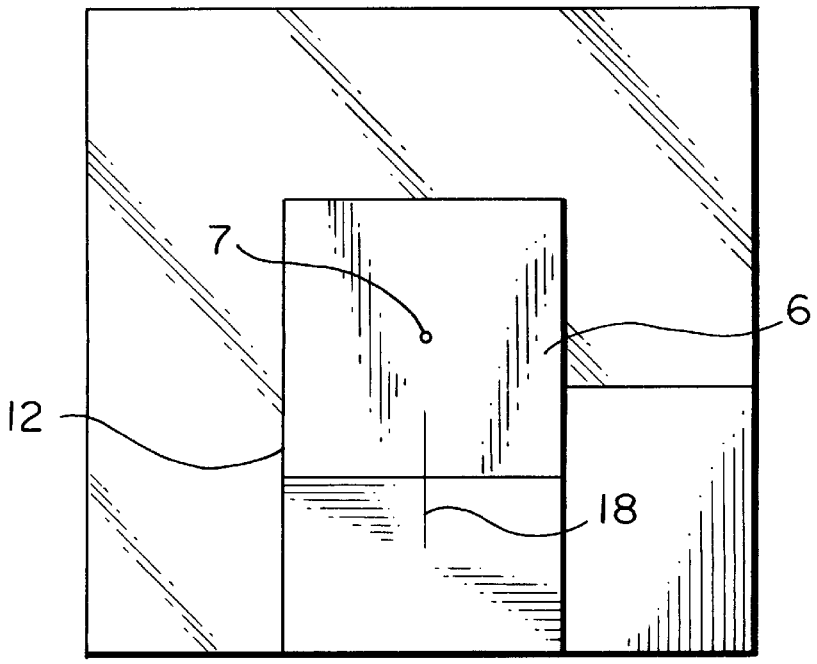
FIG. 5 is a bottom view of the invention of FIG. 1.

The base has a lower support surface 6 (see FIG. 5) and an oppositely facing upper support surface 8 (see FIG. 4) positioned parallel thereto. The lower support surface is for supporting the base on a generally horizontal surface. The upper support surface is for supporting the table top 4. The upper support surface 8 defines an upper support area having an imaginary center point 9. The lower support surface 6 defines a lower support area having an imaginary center point 7. The upper Support surface is spaced apart from the lower support surface in both a vertical direction and a horizontal direction, as measured between these center points when the lower support surface is supported on a generally horizontal surface, such as is shown in FIG. 1.

The base 2 further has an upper arm portion 10 and a lower arm portion 12, each having a longitudinal axis. The upper support surface 8 is positioned on an upper end of the upper arm portion 10 and the lower support surface 6 is positioned on a lower end of the lower arm portion 12. The lower end of the upper arm portion and the upper end of the lower arm portion come together to form an elbow 14 with the longitudinal axis of the upper arm portion forming an angle in the range of from about 110 to about 160 degrees with respect to the longitudinal axis of the lower arm portion. The longitudinal axis of the upper arm portion lies in a first plane which extends normal to the upper support surface (see indicator line 16 in FIG. 4). The longitudinal axis of the lower arm portion lies in a second plane which extends normal to the lower support surface (see indicator line 18 in FIG. 5). The first plane is normal to the second plane.

Figure 2:
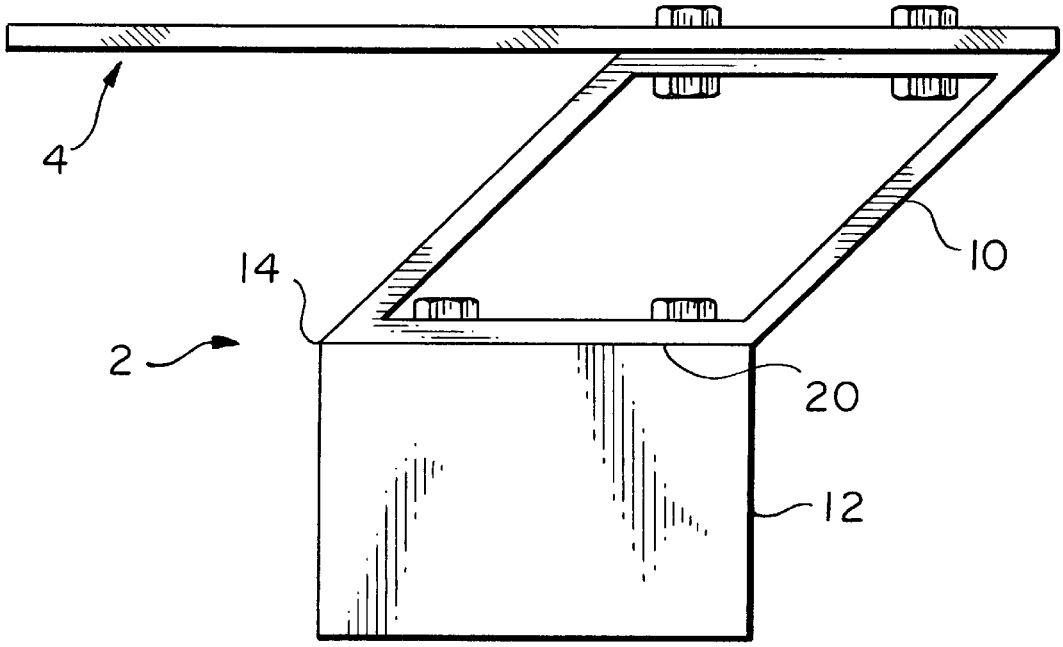
FIG. 2 is a front view of the invention of FIG. 1, from the perspective of lines 2—2 of FIG. 1.
Figure 3:
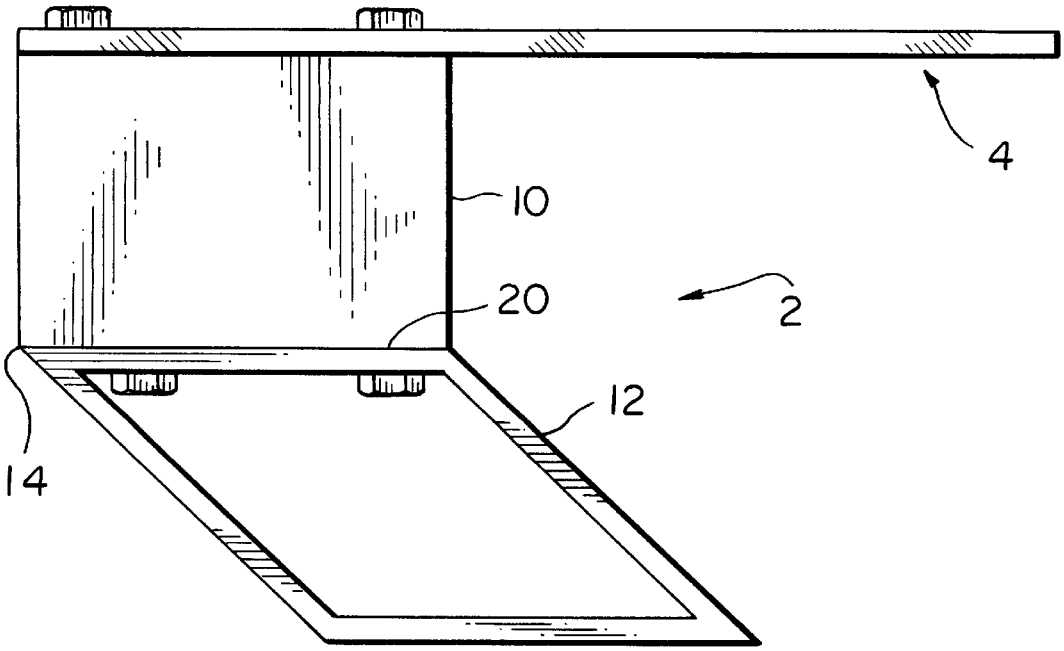
FIG. 3 is a side view of the invention of FIG. 1, from the perspective of lines 3—3 of FIG. 1.

With reference to FIGS. 2 and 3, the lower end of the upper arm portion and the upper end of the lower arm portion can come together along a parting line, which can be along a plane 20, which is parallel to the upper support surface and the lower support surface. The upper arm portion 10 can have a generally rectangular cross section normal to its longitudinal axis and the lower arm portion 12 can have a generally rectangular cross section normal to its longitudinal axis. The longitudinal axis of the upper arm portion preferably forms an angle in the range of from about 120–150 degrees with respect to the longitudinal axis of the lower arm portion.

Each element of the base 2 in a preferred embodiment can generally be described as having a polyhedral shape, preferably a parallelepiped shape. The elements can be hollow, open or solid, as desired. For example, each element can be in the form of a hollow, six sided parallelepiped formed from veneer over plywood, or each element can have an open structure, such as in the illustrated embodiment, where panels form certain of the sides of the polyhedral shape, or each element can be a solid structure, such as in the form of a concrete block of the desired polyhedral shape. However, it is also contemplated that the elements can have a tubular, generally cylindrical shape or other shape. The base preferably functions as a monopod base, although it is contemplated that a tabletop could be supported by a plurality of such base structures if desired.

In a particularly preferred embodiment, and as illustrated, the upper arm portion preferably forms at least two faces of an upper parallelepiped, and the lower arm portion forms at least two faces of a lower parallelepiped which is congrient to the upper parallelepiped. The parallelepiped forming the upper arm portion preferably has an upper rectangular face which forms the upper support surface 8 and the parallelepiped forming the lower arm portion preferably has a lower rectangular face which forms the lower support surface 6.

In the illustrated embodiment, the upper parallelepiped preferably has a lower rectangular face and the lower parallelepiped preferably has an upper rectangular face which is positioned against the lower rectangular face of the upper parallelepiped, and the upper parallelepiped is rotated 90° from the lower parallelepiped with respect to a vertical axis extending normally between a plane defined by the upper support surface and a plane defined by the lower support surface.

It is appreciated that the faces in the illustrated embodiment are congruent to each other and are each formed by a panel-shaped member which itself can be described as being a parallelepiped. However, in other embodiments of the invention these upper and lower panel-shaped parallelepipeds need not be congruent to each other. For example, two opposed (meaning, on opposite faces of the parallelepiped) generally rhombehedral panel members can form the lower arm portion and two opposed generally square panel members can form the upper arm portion. The longitudinal axis of each arm portion can be positioned at an angle of about 45 degrees with respect to the horizontal plane. The elements can be attached together by any suitable means. Nuts and bolts as shown are exemplary. The opposed panel members can be further stiffened by connection via a cross member if necessary.

The base alone is generally not in static equilibrium and is usually counterbalanced by a cantilevered top. The length, width, and thickness of the top are determined by what is the appropriate amount of material necessary (in conjunction with the thickness of the material) to counterbalance the base into balanced equilibrium.

In use, the tabletop 4 is supported on the upper support surface of the base 2. The tabletop preferably has a generally flattened hexahedral shape, having an upper surface, a lower surface, and four corners, and the tabletop is supported on the upper support surface of the base near one of said corners. By providing the assembly with a center of mass positioned vertically above the lower support surface, wherein the tabletop counterbalances the base, the table is both stable and attractive.

While certain preferred embodiments of the invention have been described herein, the invention is not to be construed as being so limited, except to the extent that such limitations are found in the claims.

What is claimed is:

1. A cantilevered base for a table top, said cantilevered base having a lower horizontal support surface for supporting the base on a generally horizontal surface, said lower horizontal support surface defining a lower support area having a center point, a horizontal upper support surface, said upper horizontal support surface defining an upper support area having a center point, wherein the upper support surface is positioned parallel to the lower support surface and faces oppositely to the lower support surface, said upper horizontal support surface being spaced apart from the lower support surface in both a vertical direction and a horizontal direction, as measured between the center point of the upper support area and the center point of the lower support area when the lower support surface is supported on a generally horizontal surface, an upper arm portion extending downwardly from the upper horizontal support surface, said upper arm portion having a longitudinal axis, a lower arm portion extending upwardly from the generally horizontal lower support surface, said lower arm portion having a longitudinal axis, wherein the upper support surface is positioned on an upper end of the upper arm portion and the lower support surface is positioned on a lower end of the lower arm portion, and a lower end of the upper arm portion and an upper end of the lower arm portion come together and are attached to form an elbow with the longitudinal axis of the upper arm portion forming an angle in the range of from about 110 to about 160 degrees with respect to the longitudinal axis of the lower arm portion, wherein the longitudinal axis of the upper arm portion lies in a first plane which extends normal to the upper support surface, the longitudinal axis of the lower arm portion lies in a second plane which extends normal to the lower support surface, wherein the first plane and the second plane come together at the elbow, and the upper arm portion and the lower arm portion are oriented so that the first plane is normal to the second plane.

2. A base as in claim 1 wherein the lower end of the upper arm portion and the upper end of the lower arm portion come together along a parting line which is parallel to the upper support surface and the lower support surface.

3. A base as in claim 1 wherein the upper arm portion has a generally rectangular cross section normal to its longitudinal axis and the lower arm portion has a generally rectangular cross section normal to its longitudinal axis.

4. A base as in claim 1 wherein the longitudinal axis of the upper arm portion forms an angle in the range of from about 120–150 degrees with respect to the longitudinal axis of the lower arm portion.

5. A base as in claim 1 wherein the upper arm portion forms at least two faces of an upper parallelepiped, and the lower arm portion forms at least two faces of a lower parallelepiped which is congruent to the upper parallelepiped, and the base comprises a monopod base.

6. A base as in claim 5 wherein the upper parallelepiped has an upper rectangular face which forms the upper support surface and the lower parallelepiped has a lower rectangular face which forms the lower support surface.

7. A base as in claim 5 wherein the upper parallelepiped has a lower rectangular face and the lower parallelepiped has an upper rectangular face which is positioned against the lower rectangular face of the upper parallelepiped, and the upper parallelepiped is rotated 90° from the lower parallelepiped with respect to a vertical axis extending normally between a plane defined by the upper support surface and a plane defined by the lower support surface.

8. A cantilevered table comprising a cantilevered base and a tabletop mounted to the cantilevered base, said cantilevered base having an upper horizontal support surface and an oppositely facing horizontal lower support surface, said lower horizontal support surface being positioned parallel to said upper horizontal support surface, an upper arm portion having a longitudinal axis, a lower arm portion having a longitudinal axis, wherein the upper support surface is positioned on an upper end of the upper arm portion and the lower support surface is positioned on a lower end of the lower arm portion, and a lower end of the upper arm portion and an upper end of the lower arm portion come together and are connected to form an elbow with the longitudinal axis of the upper arm portion forming an angle in the range of from about 110 to about 160 degrees with respect to the longitudinal axis of the lower arm portion, wherein the longitudinal axis of the upper arm portion lies in a first vertical plane which extends normal to the upper support surface, and the longitudinal axis of the lower arm portion lies in a second vertical plane which extends normal to the lower support surface, and the upper arm portion and the lower arm portion are oriented so that the first plane is normal to the second plane, and a tabletop supported on the upper support surface of the base, said tabletop having a center of mass positioned vertically above the lower support surface to counterbalance the base and provide stability.

9. A table as in claim 8 wherein the tabletop has a generally flattened hexahedral shape, having an upper surface, a lower surface, and four corners, and the tabletop is supported on the upper support surface of the base near one of said corners.

10. A table as in claim 9 wherein the base forms a monopod base for the tabletop.

* * * * *